United States Patent [19]

Debbas et al.

[11] 3,993,812

[45] Nov. 23, 1976

[54] UNBONDED FIBROUS NON-WOVEN SHEET AND ARTICLES MADE THEREFROM

[75] Inventors: Samir Costandi Debbas, Hendersonville; Arthur John Herrman, Old Hickory; Alexander Gregory Swystun, Nashville, all of Tenn.

[73] Assignee: E. I. Du Pont de Nemours and Company, Wilmington, Del.

[22] Filed: Mar. 6, 1975

[21] Appl. No.: 555,986

[52] U.S. Cl. ..... 428/35; 428/113; 428/114; 428/296; 428/298

[51] Int. Cl.[2] ..... B32B 5/12; D04H 3/02

[58] Field of Search ..... 428/113, 114, 286, 35, 428/296, 298

[56] References Cited

UNITED STATES PATENTS

| | | | |
|---|---|---|---|
| 3,563,838 | 2/1971 | Edwards | 428/286 X |
| 3,821,062 | 6/1974 | Henderson | 428/113 |

*Primary Examiner*—George F. Lesmes
*Assistant Examiner*—Henry F. Epstein

[57] ABSTRACT

An unbonded fibrous non-woven sheet comprising four layers of continuous isotactic polypropylene filaments. A shipping bag may be made from the product obtained by thermally bonding said sheet.

3 Claims, 4 Drawing Figures

UNBONDED FIBROUS NON-WOVEN SHEET AND ARTICLES MADE THEREFROM

BACKGROUND OF THE INVENTION

The use of woven and nonwoven fibrous sheets in bagging materials has been described in the literature. In general, the nonwoven materials have been used in combination with other sheet products to provide laminates with a desired set of properties. Attempts have been made to construct porous shipping bags entirely of nonwoven polypropylene fibrous sheets of low weight and low cost. However, the fuzzing resistance has been poor causing contamination of the bag contents and an unsightly appearance. In addition, bags of the nonwoven sheet frequently are weak and will burst on being dropped even from low levels.

The present invention provides a solution to such problems with a thermally bonded continuous nonwoven fibrous sheet of polypropylene filaments which can be used in making a shipping bag with high drop strength, high fuzz resistance, low porosity (low sifting) and low basis weight. The bag is useful for shipping materials such as dry foods (e.g., peanuts or soybeans) and granular industrial materials.

SUMMARY OF THE INVENTION

The invention relates to an unbonded fibrous nonwoven sheet comprising four layers of continuous isotactic polypropylene filaments, each layer comprising 22–28% of the total weight of the fibrous sheet, a first outer layer and two inner layers of said sheet having from about 8–32% by weight of filament segments having a break elongation of 400–800% with the second outer layer having from about 50–100% by weight of such segments, the remaining filament segments of said first outer layer and two inner layers having a tenacity of between 3.0 and 5.0 grams per denier, a denier of 6–32 and a percent break elongation of under 350%. In one of the inner layers a majority of the filament lengths lie at an angle of +20° to +70° relative to the machine direction and in the other inner layer at an angle of −20° to −70° relative to the machine direction.

Preferred sheet exhibit filament directionality values of XD/45° and MD/45° each less than 1.2 and greater than 0.4 wherein MD and XD are measures of the total filament lengths of the sheet in the machine and cross-machine directions respectively and 45° is the average of the measures of the total filament lengths of the sheet in the directions at 45° to the fabric length direction and wherein XD, MD and 45° are measures determined by the randometer method. The invention also relates the product obtained by thermally bonding such sheets and shipping bags made from the bonded product.

DETAILED DESCRIPTION OF THE INVENTION

The new sheet is a fibrous nonwoven sheet comprising four layers of continuous isotactic polypropylene filaments, there being no bonding material present other than that which is provided by the polypropylene. Each of the four layers comprises 22 to 28% of the total weight of the fibrous sheet and the total weight of the four layers is 100%.

The unbonded sheet of the invention may be delaminated into four web layers, each having a majority of filaments deposited at an angle to the machine direction. In one of the inner layers a majority of the filament lengths lie at an angle of +20° to +70° relative to the machine direction and in the other inner layer at an angle of −20° to −70° relative to the machine direction.

Preferred sheet products of the invention exhibit the following filament directionality values: XD/45° and MD/45° each less than 1.2 and greater than 0.4 wherein MD, XD and 45° are measures of the total filament lengths of the sheet in the respective directions and are determined as described below.

The filaments of the two outer layers of the composite sheet may be arranged in a random or in a directional manner. The inner layers of the sheet provide strength in the desired directions while both outer layers serve as fuzz-resistant surfaces and provide additional strength. The sheets of the invention have a basis weight of about 30 to 150 g/m².

The polypropylene filaments present in the unbonded four-layer sheet contain segments having high levels of molecular orientation alternating with segments having lower levels of molecular orientation (binder segments). These different levels of orientation are provided by segment drawing, whereby certain segments along the length of the filament are drawn more than other segments. Segment drawn filaments are preferred to blends of drawn and undrawn filaments because they provide uniform distribution of drawn and undrawn filament lengths. The more highly drawn segments, of course, will have a low diameter as compared with the high diameter of the less highly drawn segments. The less highly drawn filament segments, i.e., the binder segments in the unbonded sheet are those having a break elongation of 400 to 800% such that they fuse at the bonding conditions and provide a surface with high fuzz resistance on the outer layers. Such segments should be present in one outer layer and in the two inner layers to the extent of about 8 to 32% by weight and in the other outer layer to the extent of about 50 to 100% by weight. The more highly drawn filament segments have a higher molecular orientation, tenacity and melting point than the other segments. If the % break elongation of such segments is under 350%, they constitute matrix segments which do not melt at the bonding conditions employed, thus providing strength in the bonded product. If the break elongation of such segments is in excess of 400%, they too are considered as binder segments. The matrix segments should be present in the two inner layers of the sheet and in one outer layer to the extent of at least 68% by weight. They should have a denier of 6 to 32, and before bonding, a tenacity of between 3.0 and 5.0 gpd. A loss in tenacity of about 10% occurs during bonding.

The four-layer sheet is thermally bonded to provide dimensional stability. The bonding conditions that are employed are sufficient to melt the binder segments but not the matrix segments. The unbonded sheet product is particularly adapted for bonding in equipment where steam is provided from one side of the sheet as in Wyeth U.S. Pat. No. 3,313,002. In the bonding operation the outside layer having from 50 to 100% of binder segments, is located on the side away from the steam supply. The presence of more binder segments on this side of the sheet, permits adequate bonding to be achieved in spite of the greater distance from the steam supply.

In the unbonded sheet of the present invention, directionality values XD/45° and MD/45° are measured by the second randometer method described in Edwards U.S. Pat. No. 3,563,838, with the exception that randometer values are read with direction XD located exactly in the crosswise direction of the sheet rather than at the point of highest reflectance near the crosswise direction. The MD direction measurement is made at 90° to the XD direction.

THE DRAWINGS

DETAILED DESCRIPTION OF OPERATION

Figure 1:
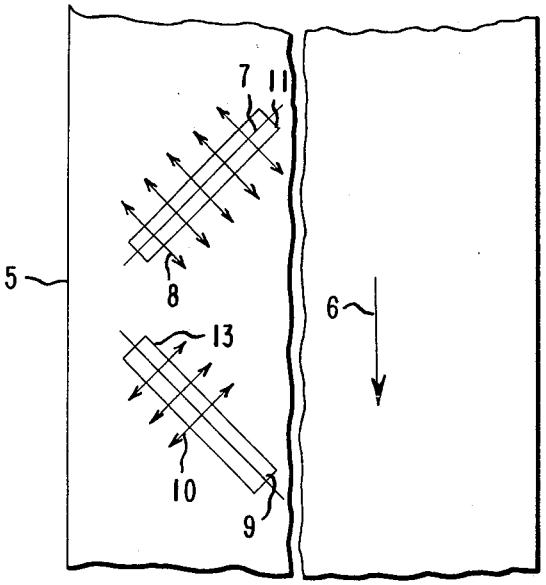
FIG. 1 is a plan view of the arrangement of slot jets over a collecting belt for preparing the fabrics of the invention.

Considering now FIG. 1, a collecting belt 5 is moving in the direction shown by the arrow 6. The inner layers of the sheet are provided by rectangular forwarding jets 11 and 13 (of the type shown in FIG. 6 of U.S. Pat. No. 3,563,838, mentioned above) whose exits are arranged at selected angles (jet angles) relative to the movement of the collecting belt beneath the jets. The jet angle for jet 11 is the angle between the long axis 7 of the jet exit and the direction of belt movement and is assumed to be positive. The jet angle of jet 13 between the long axis 9 and belt movement is thus negative. In preparing very wide sheets a large number of similarly oriented jets may be used across the width of the belt, each line of jets across the width being termed a block. For jet 11 and all other jets the filament traverse direction is at 90° to the long axis of the jet exit. The filaments exiting from jet 11 are oscillated in the direction indicated by arrows 8. The filament exiting from jet 13 are oscillated in the direction indicated by arrows 10. However, because of the movement of the belt, the filaments from either jet, as deposited, will tend to favor the direction of belt movement when the filaments are directed downstream and will tend to favor the cross-direction when the filaments are directed upstream. Excessive laying of filaments in the machine direction or cross-machine direction can be avoided by keeping the ratio of filament speed to collecting belt speed high.

Preferably the inner layers of the sheet are prepared with the axis of the jet exits in one block at +45° and in the otherblock at −45°. An additional block (not shown) is provided upstream for one outside layer and an additional block downstream (not shown) for the other outside layer. The orientation of the outside jets is less critical but the outside jets may be used to provide additional directionality if desired. The output of filaments from the most upstream block (Block 1) is deposited as a layer on the moving belt. The filaments on the belt then move forward, and the output of the next downstream block (Block 2) is deposited as a layer on top of these filaments. As the belt moves forward, the next downstream block (Block 3) deposits its output on top of the previously deposited layer. Finally, the output of the most downstream block (Block 4) deposits its layer of filaments over those laid down by Block 3. Thus, Blocks 1 and 4 provide the outer layers of the unbonded sheet while Blocks 2 and 3 provide the inner layers.

Details on the construction of the jets including provision of secondary air supplies used to promote oscillation of the filaments from side to side may be found in Edwards U.S. Pat. No. 3,563,838. The output of each jet is generally rectangular in shape.

Figure 2:
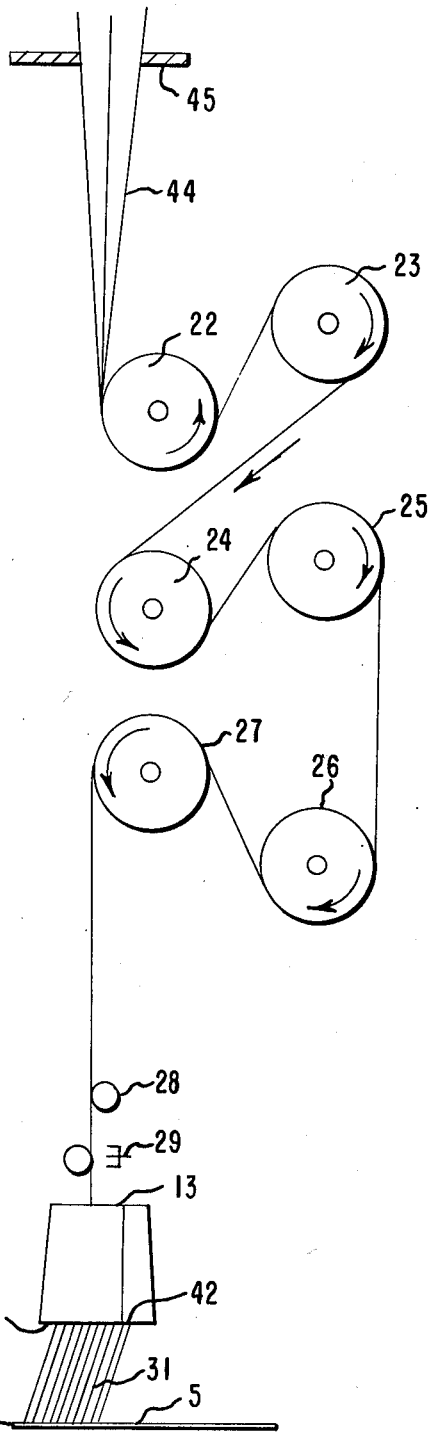
FIG. 2 is a schematic side view of an apparatus for segment drawing, electrostatically charging, and depositing of filaments by means of an air jet.

The means for obtaining the various molecular orientations of the filament segments in the sheet is similar to that described in Henderson U.S. Pat. No. 3,821,062 and will be described by reference to FIG. 2 which shows a view of the drawing and depositing equipment looking upstream toward jet 13 in FIG. 1. Jet 13 is shown in FIG. 2 situated at an angle to the belt 5 and having long dimension 43 and short dimension 42 at the jet exit. Referring to FIG. 2 a bundle of filaments 44 is provided by melt spinning. The filaments are quenched and pass through the exit 45 of the quenching chamber (not shown) to roll 22. The bundle of filaments 44 is spread by means not shown and becomes a ribbon of parallel filaments as it passes over roll 22. The filaments then travel successively over rolls 23, 24, 25, 26 and 27 and are drawn. The surface speed of the rolls increases successively from roll 23 to roll 26 thereby providing an increase in molecular orientation (draw). Rolls 26 and 27 travel at the same surface speed. Roll 25 is a fluted roll that is heated and has grooves running along its surface in the axial direction. Segments of the filaments which touch the hot surface of the roll 25 between grooves are drawn, through rotation of roll 26 at a greater speed than the preceding rolls, but those segments suspended over the grooved portions are not drawn to a significant degree and constitute binder segments. The resulting filaments have alternate segments with relatively high and relatively low molecular orientation.

The ribbon of segmentally drawn filaments passes from roll 27 to guide 28. The filaments are electrostatically charged upon passing across the target bar to a corona charging device 29 such as that described in DiSabato et al. U.S. Pat. No. 3,163,753. The ribbon of well-separated charged continuous filaments is sucked into the entrance orifice of slot jet 13 and issues from the slot jet exit for deposition on moving belt 5. A ribbon of filaments 31 is deposited in oscillating fashion by means of an air pulse applied alternately to the two sides of the jet exit. The filaments are deposited in broad sweeps which continue in a generally straight line for at least 7 inches, preferably 15 to 25 inches. Then the filaments reverse direction, and this reversal occurs in a relatively short distance, for example in 4 to 5 inches. The predominant direction of filaments in the layer is determined by observation of the filaments in the sweep portions.

Before the fibrous nonwoven sheet is suitable for use in shipping bags it must be thermally bonded. This is done by passage through high pressure saturated steam for example by using a bonder of the type described in Wyeth, U.S. Pat. No. 3,313,002. The sheet product during treatment is in a confined zone which permits steam temperatures above 100° C to be used. The heat exposure on the steam entry side of the sheet however is somewhat higher than on the other side of the sheet. The side of the sheet with the high percent binder segments is passed through the bonder so as to be farthest away from the steam entry. Thus a relatively high degree of bonding is obtained and good fuzz resistance is obtained on both faces of the sheet. While severe bonding conditions are beneficial for increasing the fuzzing resistance, excessive temperatures may be deleterious with respect to bag drop strength. Careful control of bonding conditions is therefore necessary.

Figure 3:
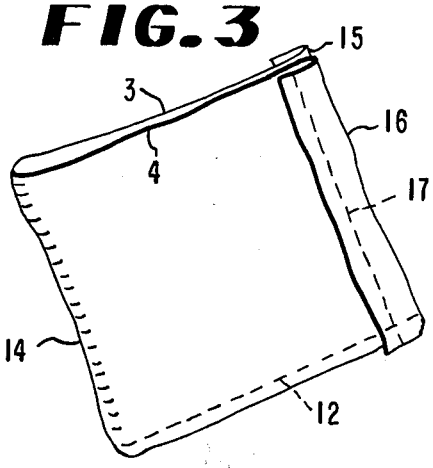
FIGS. 3 and 4 are schematic views of shipping bags.

FIG. 3 shows a rectangular sewn bag prepared from the thermally bonded sheet of the invention. To make the bag, rectangular pieces are cut from the sheet so that the sides of the rectangle are aligned in the lengthwise and cross-wise direction of the continuous sheet. The rectangular piece which is approximately twice as long as the desired bag, is then folded in half with the fold 14 derived either from the machine or cross-machine direction of the original sheet. The two meeting edges 15 and 16 form one side of the bag. Each of the edges 15 and 16 are turned back about 1 inch. Then the four layers are stitched together by stitching 17 to provide a butterfly seam. An ordinary seam 12 is provided at the bottom of the bag. Before using, the bag is turned inside out by pulling seam 12 through the opening between edges 3 and 4. The Bag Drop data reported in the Examples below were obtained on similarly constructed bags in which the axis of the fold 14 is in the cross-wise direction of the bonded sheet.

Figure 4:
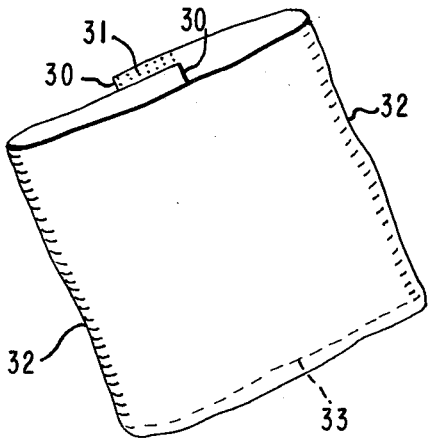

The nonwoven fabric of the invention may also be used to prepare tubular bags. These are formed in mechanical equipment which continuously forms the sheet into a cylindrical shape as shown in FIG. 4 with the axis parallel to edges 30 of the original sheet, these edges being in the machine direction. The edges 30 of the original sheet overlap and an adhesive 31 is applied in the region of overlap. As the cylindrical form collapses, a rectangular bag with folded sides 32 is formed. The bottom of the bag is closed by means of stitches 33.

TEST METHODS

The *directionality* values MD/45° and XD/45° are measured as in Edwards U.S. Pat. No. 3,563,838 except that the readings for XD are taken exactly in the transverse direction rather than at the angle of highest reflectance near the transverse direction. It will be noted that XD is a measure of the total filament length of the layered fabric in the direction perpendicular to the fabric length direction, MD is a measure of the total filament length of the layered fabric in the fabric length direction, and 45° is the average of the measures of the total filament length of the layered fabric in the directions at 45° to the fabric length direction, and wherein XD, MD and 45° are determined by the randometer method. The four-layer bonded sheets of the invention when over 68 g/m² are readily delaminated to provide two two-layer sheets of the proper weight for randometer measurements. The data for the two delaminated layers are averaged to obtain values for the total sheet. Four-layer sheets when under 68 g/m² do not require delamination before measurement in the randometer.

*Filament denier and filament tenacity* are measured on filament samples taken directly from the jets.

Bag Drop Height

The bag drop height is the total accumulated height in a modification of the bag drop test of ASTM D 959-50 (reapproved 1968). The bag to be tested is constructed as in FIG. 3 from a square sample (76 cm × 76 cm). The bag is filled with 22.7 kg of dry sand and closed by passing a piece of wire around the top as close to the load as possible and twisting the wire to tighten. The bag is dropped onto a smooth hard surface.

The test consists of several cycles each consisting of six drops. In the first cycle the bag is dropped from 0.6 meter, in the second cycle from 0.9 meter, and in the fourth cycle from 1.2 meter. Within each cycle the bag is dropped successively on one flat face, on the other flat face, on one side edge, on the other side edge, on the bottom (butt edge) and on the top. In the first cycle the total distance dropped is 3.6 meters (0.6 × 6); in the second cycle 5.4 meters (0.9 × 6); in the third cycle 7.2 meters (1.2 × 6). The total distances dropped are added up through the burst or completion of the series with a total of 16.2 meters. The drop data for five bag samples are averaged.

Fuzzing Resistance

This test is a modification of ASTM Standard D 1375, Part C, Brush and Sponge Procedure. Square Specimens (20.3 cm × 20.3 cm) are cut from the bonded nonwoven fabric with one edge along the machine direction and are wrapped around flat rectangular (10.8 cm × 29.2 cm) galvanized steel specimen holders. The holders are covered with 100 grit sandpaper to prevent specimen slippage during testing and the specimens are fastened to the holders by clamps. The total weight of the steel holder and clamp is 1125 grams. The specimens are then mounted face down on the upstanding bristles of the pilling tester. A very stiff brush is used consisting of Fuller gripped strips 8B 9051 from Fuller Brush Co. The fuzz generating brush is run for 5 minutes underneath the specimens. The next step in the ASTM procedure, i.e., subjecting the fabric to a circular rubbing action with a sponge to roll the free fiber ends into pills is omitted. The appearance of the fabric is then evaluated by comparison with visual standards. A brush fuzz rating from 1 to 5 is given with 1 being extremely fuzzy and 5 being essentially free of fuzz.

The sheet properties of the materials prepared in each of the samples is shown in Table 6. The sheet products were all bonded by passing through a bonder of the type described in Wyeth U.S. Pat. No. 3,313,002 at the conditions given in Table 6.

In each of Examples I to III, one of the inner layers has the majority of the filaments lying at an angle of +20° to +70° relative to the machine direction while the other layer has the majority of the filaments lying at an angle of −20° to −70° relative to the machine direction.

EXAMPLE I

Following the overall procedure of Example I of Henderson U.S. Pat. No. 3,821,062 polypropylene having a melt flow rate of 3.2 gm/10 min was spun at a melt temperature of 247° C through a spinneret having 1050 round holes of 0.51 mm diameter at a rate of 590 g/min/spinneret. The filaments were passed through a quench chamber and over rolls as shown in FIG. 2. Rolls 22, 23, 24, 26 and 27 were smooth surface cold rolls. Roll 25, a heated fluted roll with a circumference of about 61 cm had three depressed portions totalling 12% of the roll circumference. Segment-drawn filaments were obtained. The draw ratios and other processing conditions are shown in Table 1. The segment-drawn filaments after passing through a corona charging device 29 where an electrostatic charge was applied were fed to a jet.

Four blocks of jets were employed, each consisting of fourteen jets and each jet being fed with filaments as described above. The jet centers were 32.4 cm apart so that output from adjacent jets did not overlap significantly. Upon exiting from the jets the filaments were deflected at 90° to the long axis of the jet exit in oscillating fashion and were deposited on a grounded moving belt. Identical weights per square area were deposited from each of the four blocks to provide a total sheet weighing 85 g/m². The filaments were laid in layers on the belt in the order of blocks 1/2/3/4 from the bottom to top of the sheet.

In Example I the long axis of the jet exits for each of the four blocks were set respectively at −45°/−45°/+45°/+45° to the machine direction of the belt. MD/45 and XD/45 were each less than 1.2. It will also be observed that the percent by weight low drawn filaments in one outside layer was 100% and in the other three layers was 12%. The resulting bonded sheet was tested for total bag drop height and fuzz resistance. The product had an excellent resistance to bag drop (total drop height 9.0 meters). The fuzz resistance was high on both sides of the sheet (4.8/4.6). There was no loss through sifting of product in the bag drop until the final break point.

EXAMPLE II

Experiment 1 was repeated, but this time the jet angles were set at −30°/−30°/+30°/+30°, respectively, for the jets in the four blocks. Other process data are shown in Table 2. The resulting sheet product was bonded in a steam bonder as in Example I. The product had a good resistance to bag drop (total drop height 4.0 meters) and the fuzz resistance was still high (4.7/4.2). There was no loss of product. The product is within the scope of the invention.

EXAMPLE III

Example I was repeated except for the higher draw ratio applied to the filaments fed to block 4. It will be noted that 100% of such filaments had a break elongation of 400 to 800%. As shown in Table 6, the product had excellent resistance to bag drop (8.2 meters). The fuzz resistance was high (4.7/4.5). There was no loss of the material from the bag in the bag drop test prior to final breakage. The preparation of the sheet product of Example III is described in detail in Table 3.

EXAMPLE IV

The preparation of the product of Example IV is summarized in Table 4. The sheet product was prepared in a manner similar to that of Example I. However, the draw ratio in blocks 1 and 4 were both higher than previously. Consequently, the amount of low drawn material was lower. In this example only 12% of the filaments in block 4 had a break elongation between 400 and 600%. The resistance to bag drop for the product was still excellent (bag drop height was 7.0 meters), but the fuzz resistance for this example was exceptionally poor (1.7/2.0). The product is unacceptable for use in shipping bags. Furthermore, it has been found that any attempt to increase the amount of bonding to improve fuzz resistance by increasing bonder steam pressure for this product results in lower bag drop height. It is not possible to get the fuzz resistance up to a good level (for example 4.0) without a substantial loss in total bag drop height.

EXAMPLE V

The details for preparation of the sheet product of Example V are given in Table 5. The product of Example V is an XXMM-laid product of the type described in the Edwards patent. The product is satisfactory for carpet backing but as shown in Table 6 is unsatisfactory for use in shipping bags. The product of Example V was laid down with the long axis of the jet exits oriented at 0° to the belt direction for blocks 1 and 2 and at 90° to the belt direction for blocks 3 and 4. As shown in Table 6 the products obtained in this manner had MD/45 and XD/45 each greater than 1.2. This product is outside of the present invention. The total bag drop height was very low (2.7 meters) even when the material was bonded at a high enough pressure to give a fuzz resistance of 4.9 on one side. The product has the further disadvantage for shipping bags in that the fuzz resistance was satisfactory on only one side.

Summarizing the five examples, products of the invention are described in Examples I, II and III. These each have high bag drop height, high fuzz resistance, and low sifting loss up to the point of bag breakage. The products of Examples IV and V are outside the scope of the invention. These materials are faulty in total bag drop height and/or fuzz resistance.

TABLE I

PREPARATION OF LAYERED SHEET OF EXAMPLE I

| | Block | | | |
|---|---|---|---|---|
| | 1 | 2 | 3 | 4 |
| Angle between long axis of jet exit and MD of belt | −45° | −45° | +45° | +45° |
| Roll 26 speed, meters/min | 512 | 512 | 512 | 424 |
| Draw ratio overall, Roll 26/roll 22 | 1.80 | 2.60 | 2.60 | 1.16 |
| Draw ratio hot, Roll 26/roll 25 | 1.69 | 2.37 | 2.37 | 1.13 |
| Break elongation, % | | | | |
| low diameter segments | 325 | 215 | 215 | 459 |
| high diameter segments | 550 | 455 | 455 | 557 |
| Tenacity, gpd | | | | |
| low diameter segments | 3.2 | 4.2 | 4.2 | 2.5 |
| Denier per filament | | | | |
| low diameter segments | 10.6 | 10.6 | 10.6 | 12.6 |
| % Low diameter segments by weight | 88 | 88 | 88 | 88 |
| % High diameter segments by weight | 12 | 12 | 12 | 12 |

TABLE 2

PREPARATION OF LAYERED SHEET OF EXAMPLE II

| | Block | | | |
|---|---|---|---|---|
| | 1 | 2 | 3 | 4 |
| Angle between long axis of jet exit and MD of belt | −30° | −30° | +30° | +30° |
| Roll 26 speed, meters/min | 512 | 512 | 512 | 424 |
| Draw ratio overall, Roll 26/roll 22 | 1.80 | 2.60 | 2.60 | 1.16 |
| Draw ratio hot, Roll 26/roll 25 | 1.69 | 2.37 | 2.37 | 1.13 |
| Break elongation, % | | | | |
| low diameter segments | 260 | 190 | 190 | 469 |
| high diameter segments | 480 | 445 | 445 | 562 |
| Tenacity, gpd low diameter segments | 3.3 | 4.5 | 4.5 | 2.4 |
| Denier per filament low diameter segments | 10.6 | 10.6 | 10.6 | 12.6 |
| % Low diameter segments by weight | 88 | 88 | 88 | 88 |
| % High diameter segments by weight | 12 | 12 | 12 | 12 |

TABLE 3

PREPARATION OF LAYERED SHEET OF EXAMPLE III

| | Block | | | |
|---|---|---|---|---|
| | 1 | 2 | 3 | 4 |
| Angle between long axis of jet exit and MD of belt | −45° | −45° | +45° | +45° |
| Roll 26 speed, meters/min | 512 | 512 | 512 | 512 |
| Draw ratio overall, Roll 26/roll 22 | 1.80 | 2.60 | 2.60 | 1.40 |
| Draw ratio hot, Roll 26/roll 25 | 1.69 | 2.37 | 2.37 | 1.33 |
| Break elongation, % | | | | |
| Low diameter segments | 325 | 215 | 215 | 415 |
| High diameter segments | 470 | 455 | 455 | 600 |
| Tenacity, gpd | | | | |
| Low diameter segments | 3.2 | 4.2 | 4.2 | 2.7 |
| Denier per filament | | | | |
| Low diameter segments | 10.6 | 10.6 | 10.6 | 10.6 |
| % Low diameter segments by weight | 88 | 88 | 88 | 88 |
| % High diameter segments by weight | 12 | 12 | 12 | 12 |

TABLE 4

PREPARATION OF LAYERED SHEET OF EXAMPLE IV

| | Block | | | |
|---|---|---|---|---|
| | 1 | 2 | 3 | 4 |
| Angle between long axis of jet exit and MD of belt | −45° | −45° | +45° | +45° |
| Roll 26 speed, meters/min | 512 | 512 | 512 | 512 |
| Draw ratio overall, Roll 26/roll 22 | 2.00 | 2.60 | 2.50 | 1.70 |
| Draw ratio hot, Roll 26/roll 25 | 1.86 | 2.37 | 2.29 | 1.60 |
| Break elongation, % | | | | |
| low diameter segments | 295 | 215 | 230 | 340 |
| high diameter segments | 535 | 455 | 465 | 560 |
| Tenacity, gpd low diameter segments | 3.5 | 4.2 | 4.1 | 3.0 |
| Denier per filament low diameter segments | 10.6 | 10.6 | 10.6 | 10.6 |
| % low diameter segments by weight | 88 | 88 | 88 | 88 |
| % high diameter segments by weight | 12 | 12 | 12 | 12 |

TABLE 5

PREPARATION OF LAYERED SHEET OF EXAMPLE V

| | Block | | | |
|---|---|---|---|---|
| | 1 | 2 | 3 | 4 |
| Angle between long axis of jet exit and MD of belt | 0° | 0° | 90° | 90° |
| Roll 26 speed, meters/min | 512 | 512 | 512 | 512 |
| Draw ratio overall, Roll 26/roll 22 | 2.30 | 2.20 | 2.10 | 1.70 |
| Draw ratio hot, | 2.12 | 2.04 | 1.94 | 1.60 |

TABLE 5-continued

| PREPARATION OF LAYERED SHEET OF EXAMPLE V | Block | | | |
|---|---|---|---|---|
| | 1 | 2 | 3 | 4 |
| Roll 26/roll 25 | | | | |
| Break elongation, % | | | | |
| low diameter segments | 250 | 270 | 285 | 340 |
| high diameter segments | 490 | 500 | 515 | 560 |
| Tenacity, gpd | | | | |
| low diameter segments | 3.9 | 3.8 | 3.6 | 3.0 |
| Denier per filament | | | | |
| low diameter segments | 10.6 | 10.6 | 10.6 | 10.6 |
| % low diameter segments by weight | 88 | 88 | 88 | 88 |
| % high diameter segments by weight | 12 | 12 | 12 | 12 |

TABLE 6

| SUMMARY OF SHEET PROPERTIES | Example Number | | | | |
|---|---|---|---|---|---|
| | I | II | III | IV | V |
| MD/45° * | 0.93 | 0.80 | 1.00 | 1.06 | 1.24 |
| XD/45° * | 0.78 | 1.07 | 0.62 | 0.88 | 1.36 |
| % by weight binder segments ** (layers 1/2/3/4) | 12/12/12/100 | 12/12/12/100 | 12/12/12/100 | 12/12/12/12 | 12/12/12/12 |
| Bonder Steam Pressure, kg/cm² (absolute) | 6.46 | 6.54 | 6.60 | 6.54 | 6.67 |
| Total Bag Drop Height meters (average) | 9.0 | 4.0 | 8.2 | 7.0 | 2.7 |
| Fuzz Resistance, Rating (steam side/ opposite side) | 4.8/4.6 | 4.7/4.2 | 4.7/4.5 | 1.7/2.0 | 4.9/1.0 |

* Measured on bonded sheet
** Segments having between 400 and 800% break elongation

We claim:

1. An unbonded fibrous non-woven sheet comprising four layers of continuous isotactic polypropylene filaments, each layer comprising 22–28% of the total weight of the fibrous sheet, a first outer layer and two inner layers of said sheet having from about 8–32% by weight of filament segments having a break elongation of 400–800% with the second outer layer having from about 50–100% by weight of such segments, the remaining filament segments of said first outer layer and two inner layers having a tenacity of between 3.0 and 5.0 grams per denier, a denier of 6–32 and a percent break elongation of under 350%, one of said inner layers having a majority of filament lengths lying at an angle of +20° to +70° relative to the machine direction and said other inner layer having a majority of filament lengths lying at an angle of −20° to −70° relative to the machine directions; said sheet having filament directionality values of XD/45° and MD/45° each less than 1.2 and greater than 0.4 wherein MD and XD are measures of the total filament lengths of the sheet in the machine and cross-machine directions respectively and 45° is the average of the measures of the total filament lengths of the sheet in the directions at 45° to the fabric length direction and wherein XD, MD and 45° are measures determined by the randometer method.

2. A product obtained by thermally bonding the sheet of claim 1.

3. A shipping bag made from the product of claim 2.

* * * * *